United States Patent [19]

Kelly

[11] 4,224,797

[45] Sep. 30, 1980

[54] VARIABLE SPEED, CONDENSING STEAM TURBINE AND POWER SYSTEM

[76] Inventor: Donald A. Kelly, 58-06 69th Pl., Maspeth, N.Y. 11378

[21] Appl. No.: 795,323

[22] Filed: May 9, 1977

[51] Int. Cl.[2] ..... F01K 13/02

[52] U.S. Cl. ..... 60/652; 60/669; 60/676; 415/90; 204/129

[58] Field of Search ..... 60/648, 652, 662, 670, 60/669, 672, 676; 415/90; 204/129

[56] References Cited

U.S. PATENT DOCUMENTS

| | | | |
|---|---|---|---|
| 1,056,338 | 3/1913 | Johnsen | 415/90 |
| 1,333,838 | 3/1920 | Csanyi | 204/129 |
| 1,346,292 | 7/1920 | Becklund | 415/90 |
| 3,616,334 | 10/1971 | Aker et al. | 204/129 |

FOREIGN PATENT DOCUMENTS

| | | | |
|---|---|---|---|
| 2408434 | 9/1974 | Fed. Rep. of Germany | 60/670 |

OTHER PUBLICATIONS

"Make a Model Tesla Turbine", by Walter E. Burton, Sep. 1965 issue of *Popular Mechanics,* pp. 188–193.

*Primary Examiner*—Allen M. Ostrager
*Assistant Examiner*—Stephen F. Husar

[57] ABSTRACT

The variable speed condensing steam turbine is a simplified and effective steam expander which is built mainly of simple, low-cost sheet metal parts and is designed to provide a variable speed/torque output range.

The turbine concept is based on the past Tesla turbine principle of equally spaced rotor discs to provide a long helical path for steam expansion with high operating efficiency and minimum friction. Unlike the cylindrical Tesla turbine this unit is in conical form with uniformly varying diameter discs used to provide a variable speed/torque power output range.

A further purpose of having a uniform conical housing and uniformly increasing diameter discs is to achieve maximum steam expansion which will lead to rapid steam condensation, or a precondensation condition for the expended steam passing through the conical turbine.

A fuel conservation feature of the condensing turbine is a provision for separating hydrogen gas from a portion of the expanded/expended steam which will be conducted to the external fuel burner of the vapor generator, as part of the complete power system.

10 Claims, 6 Drawing Figures

VARIABLE SPEED, CONDENSING STEAM TURBINE AND POWER SYSTEM

BACKGROUND OF THE INVENTION

The variable speed, condensing steam turbine has been evolved by the pressing need to substantially improve the overall performance and cost/effectiveness of the closed Rankine cycle power system.

The basic attractiveness of the Rankine cycle is widely known and includes multi-fuel operation, near silent running, fewer rotating parts/accessories, and reduced maintenance requirements. Considerable development work has been done on improved performance steam/vapor engines and systems during the past years by many companies without any notable successes or promising, competitive power systems against the conventional I.C. gas engine which has now long outlived its practical usefulness.

When carefully analyzed, the main problems blocking the acceptance of either the open or closed Rankine cycle system can be clearly defined and considered. By considering each component within the engine system, each can be evaluated and various options reviewed towards optimization of each component which can thereby lead to upgrading the full engine system.

As the basic engine/expander is considered it will be noted that these can be of three types, piston, rotary or turbine with each type having its own specific characteristics.

While most of the previous engine systems have been based on the multi-piston engine type, this must be considered as the least desirable steam/vapor expander due to high friction levels, excessive weight and complexity. The piston expander does offer the advantage of a ready made unit that can be readily reworked from an I.C. engine, but this is not a valid advantage when the previous deficiencies are all taken into account.

The rotary vane or roller type of expander is simple and effective but is also handicapped by moderate friction levels and full zone lubrication requirements. This type of expander is also limited in the range of speed/torque available, unless many multi-step units are utilized with multiple steam inlets provided to each unit with a central selector valve control.

It becomes fairly obvious that a nearly ideal steam/vapor expander would be a variable-speed turbine, since the turbine already offers the lowest possible-friction level and highest possible power-to-weight ratio among the three engine/expander types. If a simple variable speed/torque feature is built into a conical Tesla type of turbine an ideal steam/vapor expander will result which can be built at low costs for a wide variety of power applications. When most of the parts for such a turbine are fabricated from simple sheet metal stampings, cost can be held to a minimum for this power component.

The next major Rankine cycle component to be considered is the steam or vapor boiler or heating coil unit. The most effective type of steam generator is the horizontal multiple uniform tubing coil arrangement with central burner unit(s). The best design consists of using many spirally wound, small diameter tubing loops because the incoming fluid or water is quickly flashed over to steam or vapor within the many small diameter tubing loops.

Any type of large tank type boiler is definitely not acceptable for closed Rankine cycle systems because of the long heating times involved to bring the fluid to the boiling point, and due to upgraded safety and maintenance requirements for these newer systems.

The burner(s) arrangement within the steam/vapor generator is a most important factor in steam generation and requires careful analysis and design to insure the most effective heat flow and fuel economy for the steam generator. The relationship between rising heat flow from the burner(s), flue gas passage, and the spacing between the multiple tubing loops is critical to uniform and effective heat transfer within the vapor generator component.

It is imperative that the working fluid/water-to-steam residence time within the steam generator be no more than seven seconds for automotive applications where quick startups are required. Other end applications may tolerate longer start-up times but this is not true for any automotive application if a nearly competitive stance is to be maintained with the current, conventional I.C. engine. A range of fluid residence time of between five and seven seconds must be the target for an acceptable vapor generator/burner assembly for these newer Rankine cycle engine systems.

Although the burners of the Rankine cycle engine system may be fired with nearly any suitable solid, liquid or gaseous fuel, it is expected that only a few liquid fuels will be considered practical for most applications. The first probably choice as a burner fuel will be kerosene because of its relatively low cost and general availability. The second suitable choice would be the alcohols—methanol and ethanol, which although are not now generally available should emerge as practical and economical fuels in the future, as world petroleum reserves are depleted. These are attractive natural, renewable fuels.

The use of a secondary fuel along with any given primary fuel has not been given much consideration for engine systems but offers some useful possibilities when the secondary fuel can be reclaimed from the engine exhaust, or by some form of fuel and exhaust reforming and/or regeneration. As an externally fired closed cycle—the Rankine closed cycle turbine system is particularly well adapted to the use of a secondary fuel since no special dual-fuel mixing provisions are needed in the external combustion process.

The secondary gaseous fuel of a closed Rankine cycle system may be readily and directly mixed and burned with any primary liquid fuel to increase the open flame intensity, or to allow the primary fuel flow to be cut back slightly as a fuel conservation measure.

The final major Rankine cycle component which requires by far the most improvement and development effort is the vapor or steam condenser which causes the expanded/expended steam or vapor flow to be changed or condensed back to its original liquid state. Some effort has been made to improve this c/c component but most of the work has failed to overcome its most prominent shortcoming which is excessive vapor flow impedance which both lowers the efficiency of the expander/engine due to pressure relief blocking and power takeoff for the cooling fan. Any attempt to use standard automotive radiators with large cooling fan(s) in a "brute force" arrangement to achieve rapid condensation is both wasteful and self-defeating to the end result. The use of the conventional automotive radiator as a Rankine cycle component is not an acceptable and practical way to cost/effective Rankine cycle operation and negates the improvements which can be made in the other major c/c components.

The ideal Rankine cycle engine condenser must rapidly condense the spent hot vapor or steam, preferrably by an expansion technique which will insure that vapor flow impedance is fully avoided or reduced to a minimum impedance effect on the turbulent vapor or steam flow within the closed loop.

The expansion condenser concept is not new having been advocated for use as a major Rankine cycle component in 1971, with a U.S. patent application filed in January of 1972. The "Helical Expansion Condenser" pending application—Ser. No. 219,985, has been granted as of March of 1977.

Essentially the expansion condensing device consists of providing a uniformly increasing duct or chamber volume into which the expended vapor or steam from the engine/expander is conducted. The uniform cooling and condensation of the vapor/steam is accomplished in two ways—firstly by conventional heat conduction and radiation thru the condenser tubing walls and—secondly, by uniform expansion whereby the expanding spent vapor/steam is proportionately cooled.

The expansion cooling effect of the expansion condenser aids the primary conduction and radiation cooling effect by uniformly reducing the vapor flow velocity which increases the vapor/steam residence time within the expansion condenser and the corresponding effectiveness of the conduction and radiation ducting means.

An important element towards the success of the expansion condensation concept and hardware is the addition of both internal and external multiple, thin fins within the larger cross-sectional zones of the duct(s) in order to sink heat at a rapid rate proportional to the uniformly increasing cross-sectional area and volume. As the expanding vapor/steam flow loses velocity quickly a threshold point is reached where condensation will begin and continues until the vapor/steam flow fully condenses at close to zero velocity within the end portions of condenser where it can be pumped back as a liquid into the vapor generator to repeat the continuous phases of the closed Rankine cycle.

If each of the major components of the closed Rankine cycle system are built according to the general outline of this background description a practical and cost/effective c/c engine system will result which would be applicable to a wide range of both mobile and stationary power needs.

SUMMARY OF THE INVENTION

The variable speed condensing steam turbine and power system relates to a closed Rankine cycle power system in which all of the major components are individually optimized and arranged in specific functional relationship to each other within a closed loop system.

Since a variable speed steam turbine offers the most attractive operating characteristics of all possible engine/expanders due to minimum friction and weight plus simplicity, it becomes the prime choice as the steam expander for this system. The specific steam turbine selected is a conical Tesla type turbine in which the equally spaced flat discs are of uniformly increasing diameter so that a variable speed capability is provided for the power system.

The steep slope conical turbine provides the further function of promoting optimum steam expansion leading to a pre-condensing condition, and in some cases possible full condensation of the working fluid-water.

Because the condensation function of the closed Rankine cycle requires the greatest attention and effort due to currently high vapor flow impedance, any steam engine/expander which provides at least a pre-condensing function will greatly relieve the heat rejection load on the major condenser component making it a simplier and smaller unit.

Since both weight and cost are always important considerations for any engine and engine system the selection of the conical Tesla turbine is nearly ideal since most of the parts including the housing shell and discs will be fabricated from stainless steel sheet.

The basic value in the Tesla type turbine is the extremely long spiral steam flow path available within a relatively small housing size, and the fact that the spiraling steam will drag-revolve each disc with a minimum of friction as it follows the expanding spiral flow path. The effectiveness of the Tesla turbine principle is borne out by the fact that with an input pressure of 125 psi the final exit pressure was reduced to about 1 psi indicating its high working efficiency.

The conical turbine housing will be designed for a full length disc rotor so that a maximum range of speed/-torque selections are achieved. Multiple steam inlet connections are uniformly positioned along the length of the turbine housing for the varying speed feature, with a central selector valve directing the steam flow into each selected steam inlet in a sequencial manner for smooth speed/torque transition.

An additional feature for some of the larger rotor discs will be the uniform location of radial torque tabs which are punched into one side of the larger discs. These radial torque tabs provide a tiny "vane" surface on which the spiralling steam flow will impinge and thereby increase the torque reaction for these larger discs. The radial torque tabs will be required for the larger discs in the larger, slower speed section of the turbine housing, to produce greater torque.

The smaller discs will not require the extra torque tabs—since these are in the high speed—lower torque section of the turbine housing. It is important that the radial torque tabs are in wedge form with the flat "vane" surface facing the steam flow, and the tapered portion of the tabs moving in the direction of rotation. The tabs must smoothly "wedge" into the direction of rotation to avoid windage and excessive turbulance problems.

Since the conical turbine will provide a pre-condensing function for the system the expansion condenser component must be closely coupled to it, or possibly an integral part of the turbine housing. The expansion condenser consists of a large diameter ring-like cylindrical housing which is fitted and sealed onto the large diameter end of the conical turbine housing. The central portion of the condenser housing is open—forming a ring-like shape into which the spent steam is further cooled towards full condensation. The cooling/condensing element within the expansion condenser housing is a continuous sheet metal ring in helical form which results in a very long vapor flow path. This long vapor flow path causes the cooling steam to give up further heat to the helical ring by direct conduction.

The condenser housing is uniformly fitted with multiple external radial fins which radiate the internal heat flow to the external air. Multiple heat pipes are uniformly and axially arrayed around the end plate of the expansion condenser housing to increase heat transfer from the internal helical ring to the outside air.

Cross fins may be added to the radial fins if required for additional radiating surfaces from the expansion condenser housing.

A combined fan and centrifugal blower will force air flow over the large diameter end of the conical turbine and the expansion condenser housing, to insure adequate cooling air flow over all of the heat rejecting surfaces. A conical baffle is located adjacent to the combined fan and centrifugal blower to cause the circulation air flow inward and then around the ends of the expansion condenser housing.

For automotive applications the large end of the conical housing of the turbine with the attached expansion condenser housing will face forward into the incoming air flow for forced air flow cooling of these heat rejecting surfaces.

When the expanding spent steam nears the end plate of the expansion condenser condensation will begin and will continue until the slowing vapor flow contacts the relatively cold end plate where complete condensation takes place. The condensed water will collect at the bottom of the condenser housing ring where it will be pumped into the vapor generators by the lower water pump.

The water pump, as a minor system component, is driven by a belt and pulley drive arrangement at the large diameter end of the conical turbine housing. The water pump is of the rotary vane and rotor type with a speed adjustment made possible by varying pulley sizes/step pulleys on both shafts.

The vapor generator components for the power system will consist of several horizontal uniform coils of tubing type with single central burners which are located on either side of the conical turbine component.

The total number and placement of these multiple vapor generator components is somewhat flexible, but they must be placed adjacent to the small diameter end of the conical turbine housing. As few as two large vapor generators may be utilized and as many as four, provided that they are placed around the small turbine end within a generally compact power package outline.

For stationary power applications two larger vapor generators are recommended, and for automotive applications where quicker startups are required, four smaller vapor generators are a better choice. When four smaller vapor generators are used they should be located at the sides, the top and bottom, so that the four steam inlet lines from the water return pump are of nearly equal length and shape. The smaller vapor generator units can be directly mounted onto the conical turbine housing, since they are not excessively heavy and slight vibration from the turbine does not adversely affect the functioning of the vapor generators.

Rotary selector valves control the location of the steam injection into the conical turbine housing for the variable speed function of the power system. Each vapor generator will have its own rotary selector valve in the steam inlet tubing lines, with each valves steam inlet position being identical with all of the others.

The steam inlet flow position within each valve is controlled by a turret disc with a single steam port and central rotating shaft. The turret type of steam selector valve is compact, easily controlled and can provide many steam outlet positions which is ideal for this variable speed/torque turbine component.

Each steam inlet line to the turbine housing must enter tangentially near the outer periphery of the discs, so that the steam will flow spirally around the discs. It is desirable that the tangential steam inlets from corresponding selector valve positions be slightly staggered so that each steam entrance flow does not impose on an adjacent steam entrance flow. The steam entrance tubing lines from each of the vapor generator enter the turbine housing at ninety degree intervals around the housing periphery to provide uniform steam expansion and even force distribution on the multiple rotor discs.

It will be noted that the steam flow introduced into the larger diameter end of the conical turbine housing will be exposed to much less cooling expansion than steam injected at the smaller, higher speed end of the conical turbine. Fortunately, during most of the power system's operating time the turbine will be operating in the high speed mode so that nearly full expansion and subsequent cooling/condensation will occur within the helical expansion component. The higher torque output requirement with steam injection at the larger diameter end will only be required during startups and for relatively short, intermittent periods for automotive applications, and only during startups for stationary power applications.

All of the rotary selector valve control shafts will be connected together, with a single control rod terminating at a control area peddle or arm, at any convenient location.

As part of the secondary fuel means and fuel conservation measure for the power system, hydrogen and oxygen gas separation will occur in the aft conical turbine component between the turbine housing and the expansion condensing component. The H2 and O components of the expanded steam will be separated by means of molecular permeation through polarized fine mesh metallic sieve cloth.

Since only a relatively small proportion of the exhausted steam flow will be separated, the permeation zones within the housing walls will be small and arranged in several individual areas consistent with gas pressure loading limits.

The small permeation zones with their fine mesh sieve cloth sections must be insulated from the metal housing walls since a polarizing voltage of about two volts D.C. must be maintained on the metallic sieve cloth permeation zones. The hydrogen permeation zones must be nearly twice the size of the oxygen permeation areas, or if all the permeation areas are made of equal size, then there must be double the number of hydrogen zones compared with the oxygen permeation zones.

Collection of the H2 and O gases is made by means of manifold ducts which are closely fitted and sealed to the component housings. Both the H2 and O ducts are brought to the separate central burners of each vapor generator, where the gases are directly burned with the primary fuel. The manifold ducts will be split to coincide with the number of central burners of the vapor generators, with the H2 and O burned separately at the burners.

As a secondary fuel the H2 may be burned with the primary fuel, kerosene and thereby increase the flame intensity for each vapor generator, or optionally will allow the primary fuel flow to be cut back as a primary fuel extending conservation measure for the power system.

While at the present time kerosene appears to be the prime candidate for the primary fuel, the use of methanol and particularly ethanol are close second choices as primary, natural renewable fuels at some future date.

A water supply tank must be mounted adjacent to the power system components to provide make-up water for the losses due to expended steam permeation and slight steam loss at the shaft seals.

The primary fuel supply must be located well away from the turbine power system as in present automotive design, and due to the extra hazard of the open flames within the vapor generator components.

The turbine power system can operate with or without the secondary fuel-steam permeation function, but is most desirable to obtain this primary fuel extending-/conservation function which will reduce operating costs and lower the level of noxious emissions for the power system.

The various objectives of the invention have been described in the background and summary of the power system. It should be understood that variations may be made in the various system components, without departing from the spirit and scope of the invention. Referring to the drawings.

Figure 1:
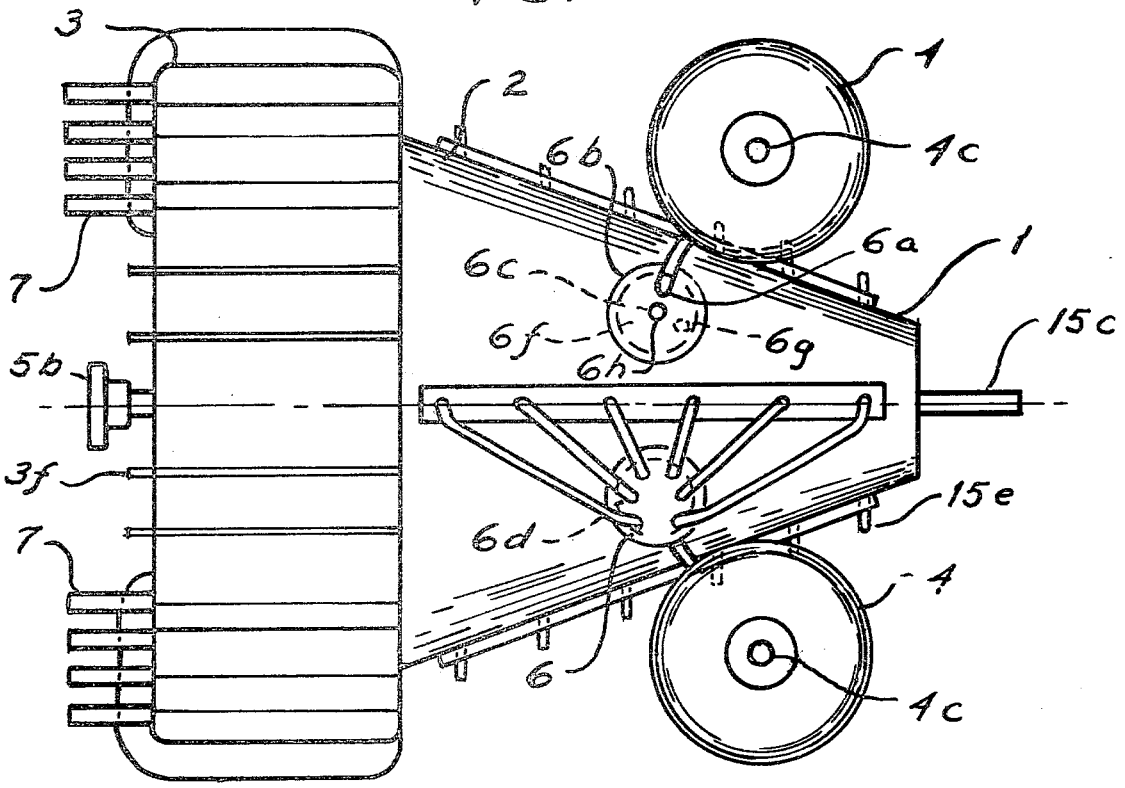
FIG. 1 is an exterior plan view of the variable speed, condensing steam turbine power system.
Figure 2:
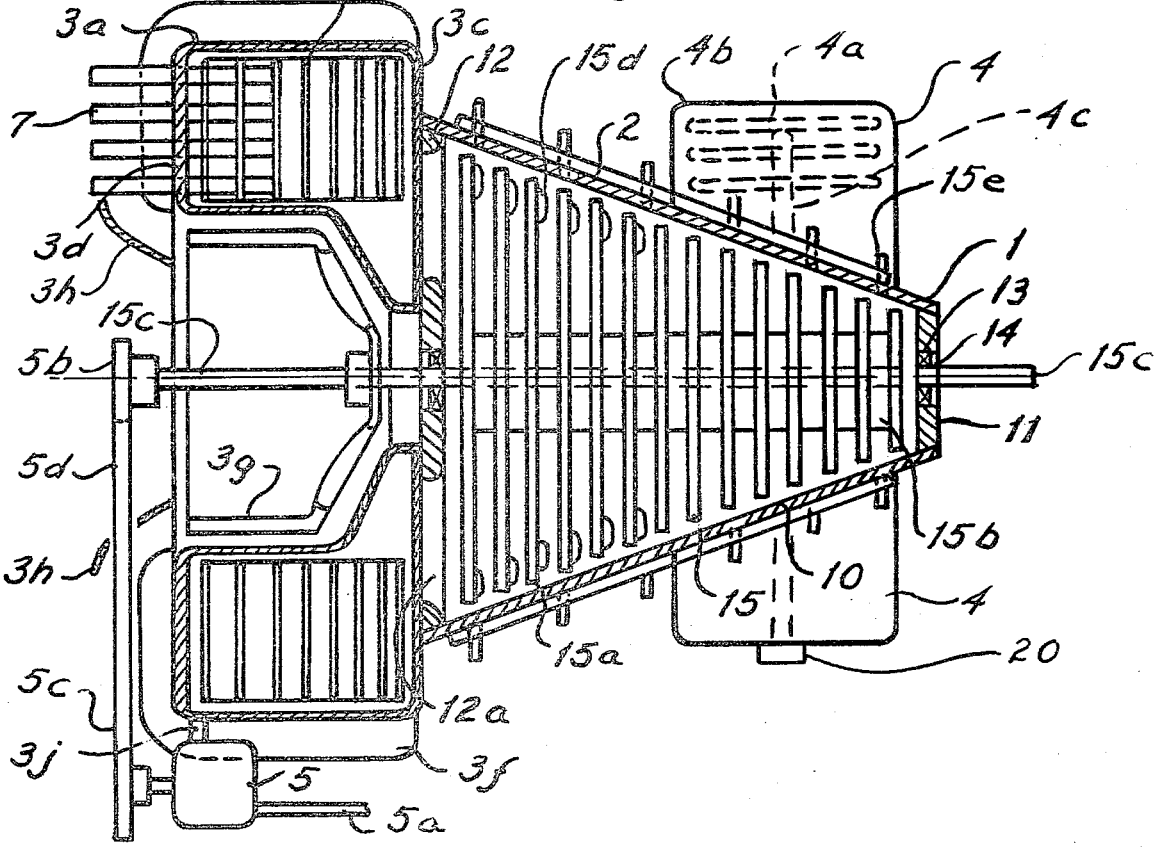
FIG. 2 is a side section view of the variable speed, condensing steam turbine power system.
Figure 3:
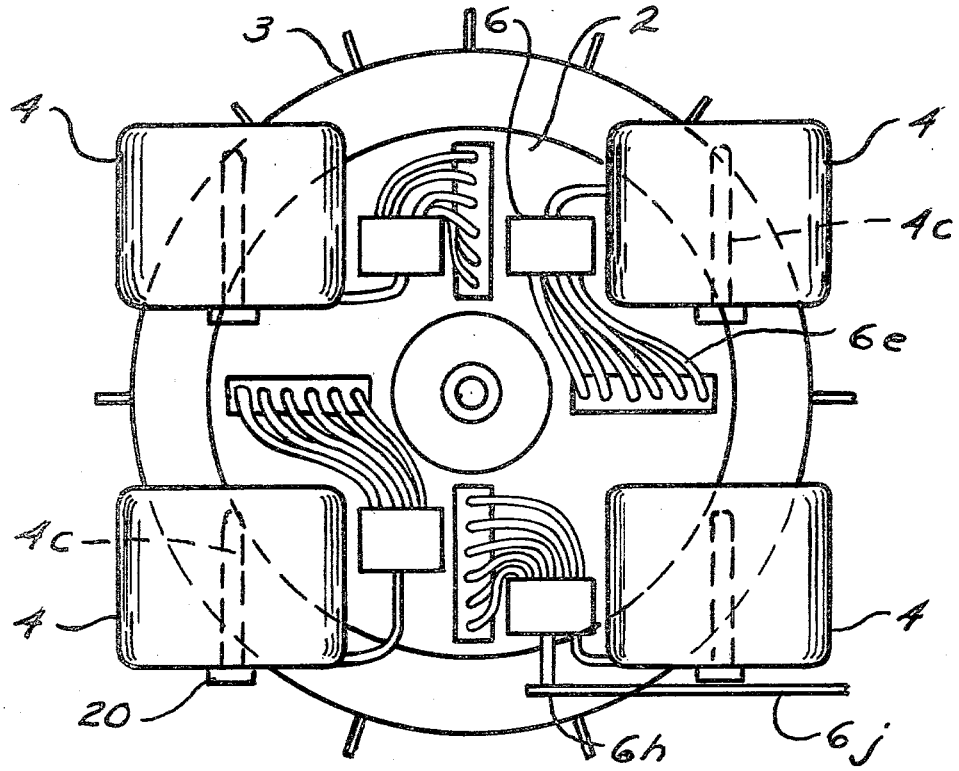
FIG. 3 is a front exterior view of the variable speed, condensing steam turbine power system.
Figure 4:
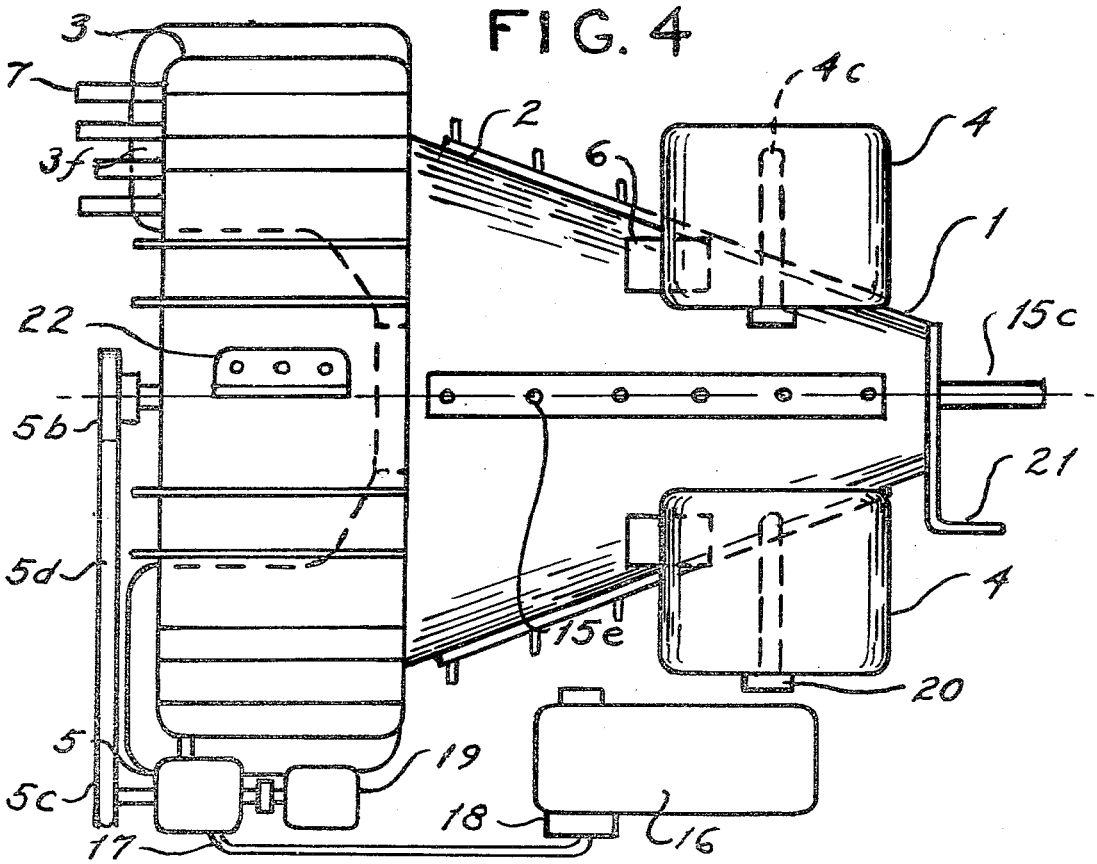
FIG. 4 is a side exterior view of the variable speed, condensing steam turbine power system.
Figure 5:
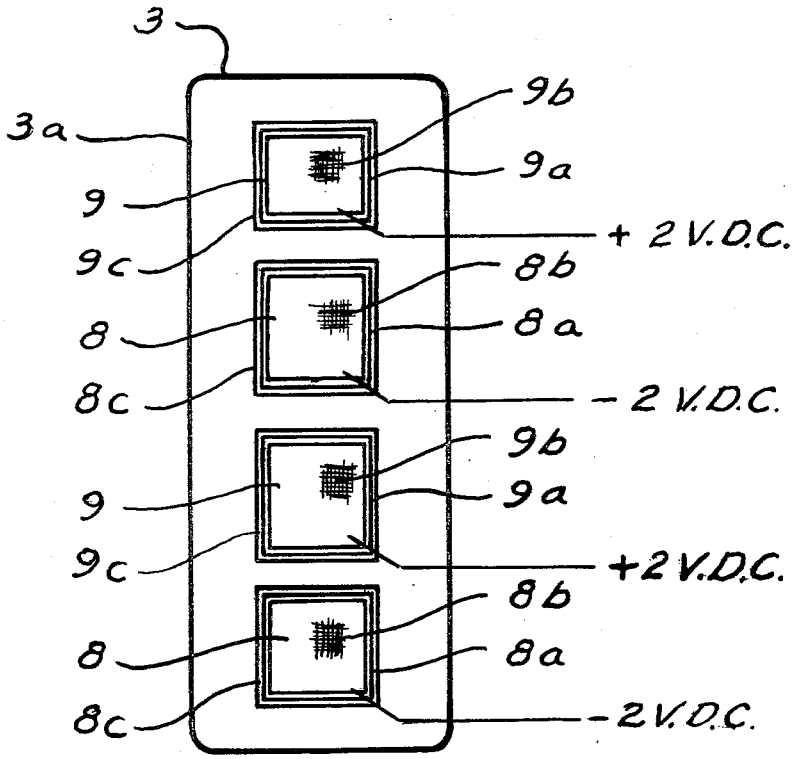
FIG. 5 is a plan view of two hydrogen permeation sections and one oxygen permeation section on the expansion condenser housing.
Figure 6:
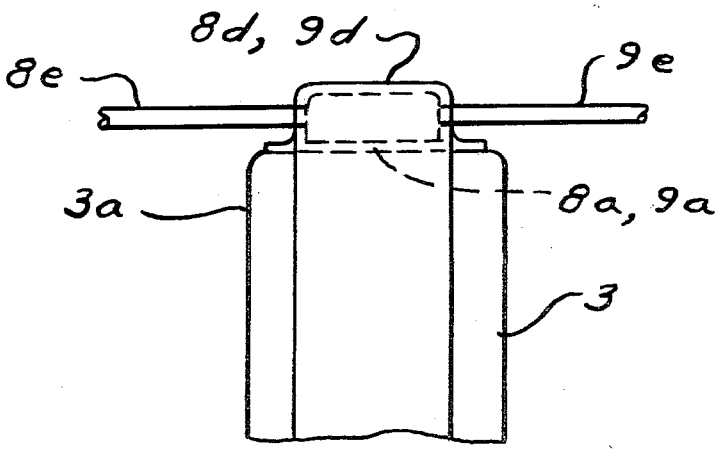
FIG. 6 is a cross-section view through hydrogen and oxygen sections showing the duct and electrical connection detail.

REFERRING TO THE DRAWINGS IN DETAIL:

The variable speed, condensing turbine power system 1, consists of three major components, the turbine expander 2, the expansion condenser 3, and the multiple vapor generators 4. Several minor components are necessary units within the closed cycle loop which are, the central burners 4*c*, the water return pump 5, the rotary selector valves 6, and the multiple heat pipes 7.

The secondary gaseous fuel portion of the power system consists of the hydrogen permeation sections 8, and the oxygen permeation sections 9, which are fitted into the housing walls of the expansion condenser 3.

The turbine expander 2, is comprised of a sheet metal housing 10, with a small end disc plate 11, fitted and sealed to one end and a large end disc plate 12, fitted and sealed to the opposite end of the housing 10. Two ball bearings 13, and two end seals 14, are fitted into the disc plates 11, and 12.

A rotor assembly 15, revolves within the housing 10, on the ball bearings 13, and is comprised of uniformly varying diameter rotor discs 15*a*, and equal diameter core discs 15*b*. Both the varying diameter rotor discs 15*a*, and core discs 15*b*, may be of equal thickness and are all joined together with suitable hardware, along with the rotor shaft 15*c*, to form a conical rotor assembly 15.

Approximately one-half of all the larger rotor discs 15*a*, will have multiple, small radial torque tabs 15*d*, which are louverlike punched protrusions within one face of each rotor disc.

Multiple steam inlet tube connections 15*e*, are uniformly located along the full length of the turbine housing 10, which are arrayed nearly tangentially to the outer peripherial zone of the multiple rotor discs 15*a*.

The large end disc-plate 12, contains multiple radial, canted slots 12*a*, which conduct the spent steam flow from the turbine expander 2, to the expansion condenser 3.

The expansion condenser 3, and its fully sealed ring type housing 3*a*, are secured to the large end disc-plate 12, of the turbine expander 2. The condensation element of the expansion condenser 3, is a long path modified helical ring 3*b*, which has closed pitched rings at the beginning of the steam-entrance plate 3*c*, which become uniformly wider pitched as the steam flow spirals around the helical path towards the condensation ring plate 3*d*.

Multiple heat pipes 7, are uniformly and axially arrayed within the condensation ring plate 3*d*, to conduct some of the heat load to the outside air. The multiple heat pipes must enter into the helical condensation ring 3*b*, to provide many heat transfer points toward the end portion of the expansion condenser 3.

Multiple external radial fins 3*f*, are uniformly located around the ring housing 3*a*, and condensation ring plate 3*d*, to dissipate the high heat load within the expansion condenser 3. A combination fan-centrifugal blower 3*g*, is secured to the turbine rotor shaft 15*c*, to provide active cooling air flow over the front end of the expansion condenser 3.

A conical baffle ring 3*h*, is located centrally over the front end of the expansion condenser 3, to direct incoming air flow into and over the ring housing 3*a*. A condensation tube outlet 3*j*, is located at the bottom, front end of the ring housing 3*a*, directly adjacent to the condensation ring plate 3*d*.

A rotary vane type of water pump 5, is connected to the condensation tube outlet 3*j*, at the bottom of the expansion-condenser 3, which collects the hot water and pumps it into each of the multiple vapor generators 4, by means of the condensate water tubes 5*a*.

The rotary pump is revolved by a power takeoff drive connected to the turbine rotor shaft 15*c*. The takeoff drive consists of a small diameter "V" groove pulley 5*b*, on the turbine rotor shaft 15*c*, which rotates the large diameter "V" groove pulley 5*c*, by means of the standard "V" belt 5*d*.

The multiple vapor generators 4, consist of single or multiple, uniform tubing coils 4*a*, which form a compact and light weight assembly. The number of tubing coils used in the vapor generators 4, is flexible and depends on the end application of the turbine power system.

The vapor generators 4, are uniformly located around the small diameter end of the turbine expander 2, so that the steam entrance tubing runs are kept as short as possible. The vapor generators 4, are horizontal, with the hot condensate water entering at the bottom of each set of tubing coils 4*a*.

An insulated ringtype housing 4*b*, covers and supports all of the tubing coils 4*a*. The central portion of the ring housing is open so that the central burner 4*c*, is located at the center of the tubing coils 4*a*.

The generated steam flow from each of the vapor generators 4, is conducted out of the top of the unit and directed to the steam selector valve 6, by means of the single steam tube 6a.

The selector valve 6, consists of a housing 6b, with a single entrance port 6c, to which the single steam tube 6a, is connected. The opposite side of the housing 6b, contains about six exit ports 6d, which are connected to the multiple steam inlet tube connections 15e, on the turbine expander 2, by means of the connection tubes 6e.

A turret disc 6f, revolves within the housing 6b, which contains a single hole 6g, which lines up with all six ports 6d, when the turret disc 6f, is revolved by means of the selector shaft 6h.

All of the selector valve shafts 6a, are connected to a linkage arrangement which joined to a single control rod and handle 6J.

The secondary gaseous fuel arrangement consists of multiple, identical hydrogen and oxygen permeation sections, 8, and 9, respectively, which are uniformly located around the outer surface of the expansion condenser ring housing 3a.

Each hydrogen permeation section consists of a squarish frame 8a, into which fine mesh sieve cloth 8b, is fitted and sealed. A squarish, open insulator 8c, electrically insulates the squarish frame 8a, from the ring housing 3a. A two volt D.C. negative electrical lead is connected to the squarish frame 8a, from a D.C. electrical battery source.

Each oxygen permeation section consists of a squarish frame 9a, into which fine mesh sieve cloth 9b, is fitted and sealed. A squarish open insulator 9c, electrically insulates the squarish frame 9a, from the ring housing 3a. A two volt D.C. positive electrical lead is connected to the squarish frame 9a, from a D.C. electric battery source.

The hydrogen and oxygen gases separated from the spent steam must be collected by the manifold ducts 8d and 9d, respectively, which are closely fitted and sealed to the expansion condenser ring housing 3a.

Multiple tubes 8e and 9e, are connected to each of the manifold ducts 8e, and 9e, respectively, which are routed to the vicinity of each of the central fuel burners 4c, within each of the vapor generators 4. Since the gases are forced out of the ring housing 3a, by the internal pressure, it is expected that sufficient flow and continuous pressure will be maintained for uniform combustion of the gases within the vapor generators 4.

A water supply tank 16, is located adjacent to the turbine power system, with a water tubing line 17, connected to the water pump 5, so that the makeup water is gravity fed and controlled by a water flow controller 18.

A primary fuel pump 19, is also driven by the water pump-power takeoff belt 5d, with the fuel flow supplied from a remotely located fuel tank - (not shown).

Pilot light units 20, are provided for each of the central burners 4c, to maintain a standby flame for quick startups of the central burners 4c.

The turbine power system 1, is provided with a front mounting bracket 21, and side brackets 22, for mounting of the assembly to any convenient frame structure.

What is claimed is:

1. A variable speed condensing steam turbine power system comprising a conical turbine expander consisting of multiple uniformly increasing diameter flat rotor discs separated by identical diameter core discs joined together with a shaft as a rotor assembly, a sheet metal conical housing enclosing said rotor assembly by means of a small end disc-plate at one end and a large end disc-plate at the opposite end, bearings and seals axially disposed within said small and large end disc-plates, multiple short tubing connections uniformly located along the full length of said sheet metal conical housing being disposed nearly tangentially to the outer diameters of said flat rotor discs, multiple canted radial slots uniformly disposed within said large end disc plate, joining and sealing of an expansion condenser housing to said large end disc-plate, a uniformly varying pitch helical condensing element disposed within said expansion condenser housing, multiple radial flat fins disposed around the outer and front surfaces of said expansion condenser housing, multiple horizontal heat pipes uniformly arrayed around the front face of said expansion condenser housing, a combination centrifugal blower/fan axially secured to the shaft of said rotor assembly disposed within the cavity formed by said expansion condenser housing, a condensate tube outlet disposed at the bottom of said expansion condenser housing, a rotary water pump connected to said condensate tube outlet at the bottom of said expansion condenser housing, a pulley and belt drive connecting said rotary water pump with the shaft of said rotor assembly, multiple vapor generators disposed adjacent to the small diameter end of said conical turbine expander on vertical axes, said multiple vapor generators comprised of multiple uniform horizontal tubing coils, insulated ring housings centrally disposed over and supporting each of said multiple uniform horizontal tubing coils, central vertical elongate fuel burners centrally disposed within each of said multiple uniform horizontal tubing coils, tubing connection means from said rotary water pump to each of said multiple vapor generators, tubing connection means from the top of said multiple vapor generators to multiple rotary selector valves, said rotary selector valves have a single steam entrance port and about eight outlet ports, a revolving disc with a single port and central shaft disposed within said rotary selector valves, tubing connection means from said multiple rotary selector valves to each of said multiple short tubing connections on said sheet metal conical housing.

2. A variable speed condensing steam turbine power system according to claim 1, in which said expansion condenser housing joined and sealed to said large end disc-plate of said conical turbine housing is of larger diameter than said large end disc-plate, said multiple canted radial slots uniformly disposed within said large end disc-plate are enclosed and sealed by the inner diameter of said expansion condenser housing, said expansion condenser housing is a large cylindrical ring-shaped sealed component, said uniformly varying pitch helical condensing element starts with a minimum pitch at the steam entrance and uniformly increases in pitch toward the exit of said expansion condenser housing, condensation of the steam against the front plate of said expansion condenser housing.

3. A variable speed condensing steam turbine power system according to claim 1, in which said rotary water pump driven by a pulley and belt drive has a large diameter pulley secured to its shaft, a small diameter pulley secured to the end of said shaft of the rotor assembly, both said large and small diameter pulleys are connected by a standard vee belt, a fuel pump with a small diameter shaft connected to said rotary pump, a liquid fuel tank remotely located from said variable speed condensing steam turbine power system, tubing connection means from said liquid fuel tank to said fuel pump, a water supply tank adjacent to said variable speed condensing steam turbine power system.

4. A variable speed condensing steam turbine power system according to claim 1, wherein said conical turbine expander consisting of multiple uniformly increasing diameter flat rotor discs are separated by core discs joined together with a shaft as a rotor assembly, a formed metal conical housing enclosing said rotor assembly with an included cone angle of between 50 degrees and seventy-five degrees, an elongate manifold plate containing said multiple uniformly spaced short tubing connections along the full length of said formed metal conical housing, mounting means for said formed metal conical housing to adjacent supporting structure.

5. A variable speed condensing steam turbine power system according to claim 1, wherein said multiple vapor generators disposed adjacent to said conical turbine housing are between two and four in number, said multiple vapor generators are comprised of multiple sets of uniform horizontal tubing coils, a double walled insulated ring housing centrally disposed over and supporting each of said multiple sets of uniform horizontal tubing coils, multiple elongate fuel burners vertically disposed within each of said multiple vapor generators, mounting of said multiple vapor generators to said variable speed condensing steam turbine.

6. A variable speed condensing steam turbine power system comprising a conical turbine expander consisting of multiple uniformly increasing diameter flat rotor discs separated by varying diameter core discs joined together with a shaft as a rotor assembly, a formed metal conical housing enclosing said rotor assembly by means of a small end disc-plate at one end and a large end disc-plate at the opposite end, bearing and seals axially disposed within said small and large end disc-plates, multiple short tubing connections uniformly located along a manifold plate which is secured and sealed to the length of said formed metal conical housing, multiple canted radial slots uniformly disposed within said large end disc-plate, joining and sealing of a large ring-shaped cylindrical expansion condenser housing to said large end disc plate, a varying pitch helical expansion condensing path disposed within said large ring-shaped cylindrical expansion condensing housing, multiple radial flat fins uniformly disposed around the outer and front surfaces of said large ring-shaped cylindrical expansion condenser housing, multiple horizontal heat pipes uniformly arrayed around the front face of said large ring-shaped cylindrical expansion condenser housing, a combination centrifugal blower-fan axially secured to the shaft of said rotor assembly disposed within the cavity formed by said expansion condenser housing, a conical baffle disposed adjacent to said combination centrifugal blower-fan, a condensate tube outlet disposed at the bottom of said expansion condenser housing, a rotary water pump connected to said condensate tube outlet at the bottom of said expansion condenser housing, hydrogen and oxygen gas permeation sections disposed on the outer periphery of said large ring-like cylindrical expansion condenser housing, each of said hydrogen and oxygen sections comprised of fine mesh sieve cloth fitted into squarish frames, insulation means between each of said squarish frames and said large ring-like cylindrical expansion housing, low voltage direct current electrical connections to each of said squarish frames, sealed duct means connecting each of said hydrogen and oxygen gas permeation sections with central fuel burners of multiple vapor generators, said multiple vapor generators are disposed adjacent to the small diameter end of said conical turbine expander on vertical axes, said multiple vapor generators are comprised of multiple small diameter tubing coils, in a horizontal plane, insulated housings centrally disposed over and supporting each set of said multiple horizontal small diameter tubing coils, said central fuel burners are in elongate form and vertically disposed within each of said multiple vapor generators, tubing connection means from said rotary water pump to the bottom of each of said multiple vapor generators, tubing connection means from the top of each of said multiple vapor generators to multiple rotary selector valves, said rotary selector valves having a single steam entrance port and multiple outlet ports, a revolving disc with a single steam port and central shaft means within each of said rotary selector valves, tubing connection means from said multiple outlet ports of said multiple rotary selector valves to each of said multiple short tubing connections uniformly located along a manifold strip.

7. A variable speed condensing steam turbine power system according to claim 6, in which each of said hydrogen and oxygen permeation sections comprised of fine mesh sieve cloth is of two different sizes, fine mesh sieve cloth for said, hydrogen permeation sections which allow only the free passage of hydrogen molecules, fine mesh sieve cloth for said oxygen permeation sections which allows only the free passage of oxygen molecules, fine mesh sieve cloth fabricated of fine diameter stainless steel wire, securing and sealing means for said squarish frame and insulation means with said large ring-like cylindrical expansion condenser housing, said low voltage direct current electrical connections are of negative polarity to each of said hydrogen permeation sections, said low voltage direct current electrical connections are of positive polarity to each of said oxygen permeation sections.

8. A variable speed condensing steam turbine power system, according to claim 6, wherein said duct means connecting each of said hydrogen and oxygen gas permeation sections are connected to manifold outlets secured and sealed to said large ring-like cylindrical expansion housing, said fine mesh sieve cloth for said hydrogen permeation sections are double the number of said oxygen permeation sections, both of said hydrogen and oxygen permeation sections are of equal size, said hydrogen and oxygen permeation sections are disposed around the full periphery of said large ring-like cylindrical expansion condenser housing.

9. A variable speed condensing steam turbine power system according to claim 6, in which said expansion condenser housing joined and sealed to said large end disc plate of said conical turbine housing is larger in diameter than said large end disc-plate, said multiple canted radial slots uniformly disposed within said large end disc-plate are enclosed and isolated from the inner diameter of said expansion condenser housing, said varying pitch helical expansion condensing path disposed within said large ring-shaped cylindrical expansion condenser has the pitch at a minimum at the entrance for the steam and uniformly increased pitch toward the outlet of the steam adjacent to said condensate tube outlet, a water supply tank adjacent to said variable speed condensing steam turbine power system, a liquid fuel supply tank remotely located from said variable condensing steam turbine power system, tubing connection means from said liquid fuel supply tank to said rotary fuel pump, tubing connection means from said water supply tank to said large ring-shaped cylindrical expansion condenser.

10. A variable speed condensing steam turbine power system, according to claim 6, wherein said rotary water pump is driven by a pulley and belt drive arrangement, a large diameter vee groove pulley on said rotary water pump, a small diameter vee groove pulley secured to the end of said shaft of the rotor assembly, both large diameter vee groove pulley and small diameter vee groove pulley connected by a standard vee belt, a fuel pump with small diameter vee groove pulley driven by said standard vee belt, said multiple vapor generators comprised of multiple sets of uniform horizontal tubing coils, all of said multiple vapor generators directly mounted onto said conical turbine expander by suitable frame and hardware means, a minimum of two of said multiple vapor generators and a maximum of four vapor generators for said variable speed condensing steam turbine power system.

* * * * *